US008051901B2

(12) United States Patent
Schonberger et al.

(10) Patent No.: US 8,051,901 B2
(45) Date of Patent: Nov. 8, 2011

(54) MASS TRANSFER OR HEAT-EXCHANGE COLUMN WITH MASS TRANSFER OR HEAT-EXCHANGE AREAS, SUCH AS TUBE BUNDLES, THAT ARE ARRANGED ABOVE ONE ANOTHER

(75) Inventors: Manfred Schonberger, Tacherting (DE); Sebastian Grill, Taufkirchen (DE); Alfred J. Wagner, Polling (DE); Markus Hammerdinger, Tacherting (DE)

(73) Assignee: Linde Aktiengesellschaft, Munich (DE)

( * ) Notice: Subject to any disclaimer, the term of this patent is extended or adjusted under 35 U.S.C. 154(b) by 406 days.

(21) Appl. No.: 12/374,159

(22) PCT Filed: Jul. 6, 2007

(86) PCT No.: PCT/EP2007/005991

§ 371 (c)(1), (2), (4) Date: May 12, 2009

(87) PCT Pub. No.: WO2008/009357

PCT Pub. Date: Jan. 24, 2008

(65) Prior Publication Data

US 2009/0301130 A1 Dec. 10, 2009

(30) Foreign Application Priority Data

Jul. 20, 2006 (DE) ..... 10 2006 033 697

(51) Int. Cl.
*F28D 7/00* (2006.01)

(52) U.S. Cl. ..... 165/157; 165/159; 165/163; 62/614

(58) Field of Classification Search ..... 62/600, 62/606, 614, 611; 165/157, 159, 163; 95/227
See application file for complete search history.

(56) References Cited

U.S. PATENT DOCUMENTS

| | | | | |
|---|---|---|---|---|
| 3,146,075 | A | 8/1964 | Robb et al. | |
| 3,788,281 | A * | 1/1974 | Van Lookeren Campagne | 122/7 R |
| 3,958,951 | A | 5/1976 | Woebcke et al. | |
| 4,579,088 | A * | 4/1986 | Kim et al. | 122/34 |
| 4,721,065 | A | 1/1988 | Mohrenstecher et al. | |
| 5,144,809 | A | 9/1992 | Chevalier et al. | |
| 6,089,312 | A * | 7/2000 | Biar et al. | 165/118 |

FOREIGN PATENT DOCUMENTS

| | | | |
|---|---|---|---|
| DE | 945 395 | C | 7/1956 |
| DE | 1 442 852 | A1 | 12/1968 |

(Continued)

*Primary Examiner* — Frank Lawrence, Jr.

(74) *Attorney, Agent, or Firm* — Millen, White, Zelano & Branigan, P.C.

(57) ABSTRACT

The invention relates to a mass transfer or heat-exchange column, a tube bundle heat exchanger, with a first mass transfer or heat-exchange area, a first tube bundle (2), and a second mass transfer or heat-exchange area, in particular a second tube bundle (8), that is arranged spatially above the first mass transfer or heat-exchange area, which are surrounded by a cover (10'). In a tube bundle heat exchanger according to the invention, a lower end section (40) of the second, smaller tube bundle (8) projects into a cover part (13') of the first, larger tube bundle (2), by which an intermediate space (41) is formed between the lower section (40) of the second tube bundle (8) and the cover part (13'). In the area of this intermediate space (41), an inlet (26) for injecting a medium into the column and optionally a manhole (36) are arranged on the cover part (13').

17 Claims, 7 Drawing Sheets

FOREIGN PATENT DOCUMENTS

| | | | |
|---|---|---|---|
| DE | 25 13 499 | A1 | 10/1975 |
| DE | 29 03 466 | A1 | 7/1980 |
| DE | 36 02 935 | A1 | 8/1987 |
| FR | 2 665 755 | A1 | 2/1992 |

* cited by examiner

MASS TRANSFER OR HEAT-EXCHANGE COLUMN WITH MASS TRANSFER OR HEAT-EXCHANGE AREAS, SUCH AS TUBE BUNDLES, THAT ARE ARRANGED ABOVE ONE ANOTHER

The invention relates to a mass transfer or heat-exchange column with at least two mass transfer or heat-exchange areas, in particular tube bundles, that are arranged above one another, and an inlet for injecting a medium into the column or an outlet for removing a medium from the column or a manhole. The invention also relates to the use of a tube bundle heat exchanger in a process for liquefying a hydrocarbon-containing stream such as natural gas.

FIG. 1 and FIG. 3 show a tube bundle heat exchanger of the above-mentioned type that is used in a process for liquefying a hydrocarbon-rich stream, such as a natural gas stream. FIG. 1 shows the tube bundle heat exchanger in a diagrammatic comprehensive view. In FIG. 3, a section of the tube bundle heat exchanger, covered in FIG. 1 in dashed lines, is shown in a detailed view.

The tube bundle heat exchanger comprises a first tube bundle 2, which comprises a large number of tubes that are wound in several layers around a first central tube 3. The tube bundle 2 has an outside diameter d1. The tubes are combined in several groups—here, three groups 4, 5 and 6—on the ends of the tube bundle 2. This is thus a three-flow tube bundle. The possibility thus exists to control the three fractions separately from one another by the tube bundle 2.

Spatially above the first tube bundle 2, a second tube bundle 8 is arranged coaxially at a distance to the first tube bundle 2. The latter also comprises a large number of tubes that are wound in several layers over a second central tube 9. The tubes are combined at the ends of the tube bundle 8 into two groups 7 and 12, so that two fractions can be directed through the two-flow tube bundle 8. With d2, the second tube bundle 8 has a smaller outside diameter than the first tube bundle 2 with d1.

The two tube bundles 2 and 8 are surrounded by the same cover 10, which defines an external space 11 around the tubes of both tube bundles 2 and 8. The cover 10 comprises a first cover part 13, which surrounds the first tube bundle 2, and a second cover part 14, which surrounds the second tube bundle 14. The second cover part 14, with D2 in compliance with the smaller tube bundle 8, has a smaller inside diameter than the first cover part 13 with D1. In the production of the tube bundle heat exchanger, first two separate pieces of equipment are produced, of which one comprises the first tube bundle 2 with the first cover part 13 and the other comprises the second tube bundle 8 with the second cover part 14. The cover parts 13 and 14 are then welded to one another. They generally in turn consist of several cover parts that are welded to one another.

As can be seen from FIG. 3, the lower tube ends of the second tube bundle 8 are oriented axially to the cover 10 and are inserted in the tube bottoms 16 and 17 that are arranged on the cover part 14 and welded with the latter. Caps 18, 19 are welded on the tube bottoms 16 and 17, so that starting at the caps 18, 19, in each case a medium can be divided into the tubes of the tube groups 7, 12 or the medium that flows into the tubes of each tube group 7, 12 can be merged in one of the caps 18, 19. The tube bottoms 16 and 17 are located at the same height on the tube bundle heat exchanger.

The upper tube ends of the first tube bundle 2 are also oriented axially to the cover 10 and are inserted in tube bottoms that are arranged on the cover part 13, whereby of the total of three, since it provides three tube groups 4, 5 and 6, only two tube bottoms 21 and 22 are depicted. Caps 23 and 24 are mounted on the tube bottoms 21, 22. The third tube bottom and the third cap cannot be seen in the view that is shown. The third tube bottom is located, however, at the same height as the two tube bottoms 21 and 22 that are shown.

As can be seen from FIG. 1, the tubes of the tube group 6 of the first tube bundle 2 are directly flow-connected to the tubes of the tube group 12 of the second tube bundle 8. The tubes of the tube group 5 are directly flow-connected to the tubes of the tube group 7. The flow connection is in each case produced by tube lines between the caps 19 and 24 shown in FIG. 3 and between the caps 18 and 23.

The production of a tube bundle heat exchanger with a tube bundle is described in more detail in the article of W. Förg et al., "Ein neuer LNG Baseload Prozess und die Herstellung der Hauptwärmetauscher, Linde-Berichte aus Technik und Wissenschaft [A New LNG Baseload Process and the Production of the Main Heat Exchanger, Linde Reports from Technology and Science]," No. 78 (1999), pages 3 to 11.

In addition, an inlet 26, for example a nozzle 26 with an inlet opening 25, is arranged on the cover part 13, as depicted in FIG. 3. The inlet 26 is located at a height of the tube bundle heat exchanger between the lower tube bottoms 21, 22 and the upper tube bottoms 16, 17. As shown in FIG. 1, the tubes of the tube group 4 of the first tube bundle 2 are directly flow-connected to the inlet 26. Via the inlet 26, a medium can be injected into the external space 11. In a known process for liquefying natural gas, in this case this is a refrigerant that is cooled in tubes of the first tube bundle 2 and that is throttled before its injection.

As depicted in further detail in FIG. 3, the distribution of the injected medium is carried out via a baffle box 27 and a ring pre-distributor 28, as it is described in more detail in, for example, DE 10 2004 040 974 A1. Drain pipes 29 starting at the ring pre-distributor 28 run the liquid portion of the injected medium into a distributor device 30, which distributes the liquid over the cross-section of the first tube bundle 2 in the external space around the tubes of the first tube bundle 2. Suitable distributor devices are described in, for example, the above-mentioned DE 10 2004 040 974 A1.

In addition, the tube bundle heat exchanger below the second tube bundle 8 has a collecting device 32, which collects liquid medium that flows out from the external space 11 around the tubes of the upper, second tube bundle 8. Via a drain pipe 34, the liquid medium is injected into the ring pre-distributor 28, where it is mixed with the medium injected via the inlet 26.

Since the inlet 26 has to be removed far enough away from other devices, openings or welds on the cover 10 of the tube bundle heat exchanger, for example from the tube bottoms 21 and 22 or from the weld 31, indicated in FIG. 3, on the upper end of the first cover part 13, and the baffle box 27 as well as the ring pre-distributor 28 occupy space in the longitudinal direction of the tube bundle heat exchanger; a considerable space is required overall in the longitudinal direction of the tube bundle heat exchanger between the first tube bundle 2 and the second tube bundle 8.

By arranging the two tube bundles 2 and 8 over one another and by the space required by the injection between the two tube bundles 2 and 8, the tube bundle heat exchanger achieves a considerable structural height. If moreover, a manhole 36, as depicted in FIG. 1 in dashed lines, is required, which cannot be arranged at the height of the inlet 26, the distance between the tube bundles 2 and 8 in longitudinal direction of the tube bundle heat exchanger has to be still further enlarged. Since the manhole 36 has to be far enough away from the inlet nozzle 26 and the tube bottoms 21 and 22, it has to be in the longitudinal direction of the tube bundle heat exchanger and thus in turn in the vertical direction.

The sensitivity to wind and the costs of platforms and conductors, which increase with increasing structural height, are disadvantageous with a tall structure. If the tube bundle heat exchanger comprises still further tube bundles with additional injection points, considerable structural heights can result.

FIG. 7 shows a mass transfer column, for example a rectification column, with two mass transfer areas 102 and 108, such as, for example, packings, that are arranged above one another. Also, here, a considerable structural height of the column is achieved by the mass transfer areas 102 and 108 and by the space that is required between the upper end of the lower mass transfer area 102 and the lower end of the upper mass transfer area 108 for an injection via an inlet 26 and optionally for a manhole 36.

The object of the invention is therefore to provide a mass transfer or heat-exchange column of the above-mentioned type, in particular a tube bundle heat exchanger, with reduced structural height.

This object is achieved with a heat or mass transfer column according to claim 1 or a tube bundle heat exchanger according to claim 4.

Accordingly, a mass transfer or heat-exchange column is provided with a first mass transfer or heat-exchange area, in particular a first tube bundle, and a second mass transfer or heat-exchange area that is arranged spatially via the first mass transfer or heat-exchange area, in particular a second tube bundle, which are surrounded by a cover. The column comprises (a) at least one inlet for injecting a medium into the column or (b) at least one manhole for accessibility to the column or (c) at least one outlet for removing a medium from the column. According to the invention,

- a first, in particular lower section of the second mass transfer or heat-exchange area is separated by a first intermediate area from the cover of the column, whereby the first intermediate space is formed such that the cover in the area of the first, in particular lower section has a larger diameter than in the area of a second, in particular upper section of the second mass transfer or heat-exchange area and/or
- a first, in particular upper section of the first mass transfer or heat-exchange area is separated by a second intermediate space from the cover of the column, whereby the second intermediate space is formed such that the cover in the area of the first, in particular upper section, has a larger diameter than in the area of a second, in particular lower section of the first mass transfer or heat-exchange area, and whereby the inlet and/or the manhole and/or the outlet is/are arranged in the area of the first intermediate space and/or the second intermediate space.

Thus, the inlet, the manhole or the outlet are arranged at the height of a mass transfer or heat-exchange section, i.e., parallel to a mass transfer or heat-exchange section and not as in the prior art between the mass transfer or heat-exchange areas that are arranged above one another. Thus, the distance of the mass transfer or heat-exchange areas, arranged above one another, can be reduced relative to the prior art, and thus the structural height of the column can be reduced.

In a preferred embodiment, the mass transfer or heat-exchange column has a first cover part with a first diameter and a second cover part with a second diameter, whereby the first diameter is larger than the second diameter and whereby the first mass transfer or heat-exchange area and the lower section of the second mass transfer or heat-exchange area are arranged in the first cover part, and the upper section of the second mass transfer or heat-exchange area is arranged in the second cover part. Such a configuration is advantageous when the first mass transfer or heat-exchange area has a larger outside diameter than the second mass transfer or heat-exchange area. The possibility then exists to allow the lower section of the second, smaller mass transfer or heat-exchange area to project into the first cover part, whose diameter in compliance with the first mass transfer or heat-exchange area is larger than the outside diameter of the second mass transfer or heat-exchange area. Thus, an annular intermediate space is provided in the cover around the lower section of the second mass transfer or heat-exchange area. And thus, the possibility is given to arrange the inlet and/or outlet and/or the manhole on the cover in the area of this intermediate space.

The mass transfer or heat-exchange column can also have three column sections, a first column section with a first diameter and a second column section with a second diameter as well as a third column section with a third diameter that is located between the first and the second column sections, whereby the first mass transfer or heat-exchange area is arranged in the first column section, the lower section of the second mass transfer or heat-exchange area is arranged in the third column section, and the upper section of the second mass transfer or heat-exchange area is arranged in the second column section, whereby the third diameter is larger than the second diameter and the first diameter is smaller or larger than the third diameter. Thus, a configuration is also covered in which the mass transfer or heat-exchange areas have the same outside diameter. In this case, a central, third column section with a larger, expanded diameter is then provided, which surrounds the lower section of the second mass transfer or heat-exchange area. The mass transfer or heat-exchange column according to the invention can also have more than three column sections.

Within the scope of this invention, a tube bundle heat exchanger is also provided with at least a first tube bundle and a second tube bundle arranged spatially over the first tube bundle, whereby the two tube bundles are surrounded by a cover, which defines an external space around the tubes of the two tube bundles, and the tube bundle heat exchanger has an inlet for injecting a medium, in particular a liquid medium, into the external space around the tubes of the first tube bundle and/or a manhole for accessibility to the external space. According to the invention, a first, in particular lower section of the second tube bundle is separated from the cover by an intermediate space that surrounds the first, in particular lower section, whereby the intermediate space is formed such that the cover in the area of the first, in particular lower section of the second tube bundle has a larger diameter than in the area of a second, in particular upper section of the second tube bundle, and whereby the inlet and/or the manhole is/are arranged in the area of the intermediate space. By the parallel arrangement of the inlet and/or the manhole in the first, in particular lower section of the second, upper tube bundle, the distances of the tube bundles to one another and thus the structural height of the tube bundle heat exchanger can be reduced in comparison to the prior art.

If the first tube bundle has a diameter that is distinguished from the diameter of the second tube bundle, the possibility exists that smaller tube bundles can project over a portion of its length in the cover of the larger tube bundle, by which the intermediate space is formed. Preferably, the second, upper tube bundle has a smaller diameter than the first, lower tube bundle.

Preferably, one or more of the following devices are arranged in the intermediate space that surrounds the lower section of the second tube bundle: a redirecting means for redirecting the injected medium, a phase-separating means for separating the injected medium into its phases, and a distributor for distributing the injected medium into the external space. The space that is required by these devices then no longer needs to be provided between the tube bundles that are arranged above one another as in the prior art, by which the distance of the tube bundles to one another and thus the structural height of the tube bundle heat exchanger can be reduced.

Preferably, the cover of the tube bundle heat exchanger according to the invention has a first cover section with a first diameter and a second cover section with a second diameter as well as a third cover section with a third diameter that is located between the first and second cover sections, whereby the first tube bundle is arranged in the first cover section, the lower section of the second tube bundle is arranged in the third cover section, and the upper section of the second tube bundle is arranged in the second cover section, whereby the third diameter is larger than the second diameter, and the first diameter is larger than the third diameter. In this embodiment, the diameter of the third cover section, which surrounds the lower section of the second tube bundle, can optimally be matched to the space that is required by an inlet, a manhole, and redirecting, phase-separation and distributor devices.

Preferably, in the tube bundle heat exchanger according to the invention, the second tube bundle comprises a large number of tubes, which are wound around a central tube, whereby the tubes are merged on the lower end of the second tube bundle into one or more groups in one or more bundle devices, in particular tube bottoms, and whereby at least one inlet, in particular a nozzle, for injecting a medium into the external space and/or a manhole is arranged at a height of the tube bundle heat exchanger that is located above at least one bundle device.

In addition, the invention relates to the use of such a tube bundle heat exchanger for implementing an indirect heat exchange between a hydrocarbon-containing stream and at least one coolant or refrigerant.

Preferably, a refrigerant that is subcooled and then throttled in the tubes of the first tube bundle is injected through an inlet that is arranged in the area of the intermediate space and distributed into the external space around the tubes of the first tube bundle.

The hydrocarbon-containing stream can be formed by, for example, natural gas.

Additional features and advantages of the invention are now described in more detail based on embodiments relative to the accompanying figures. Here:

FIG. 1 shows a tube bundle heat exchanger according to the prior art with two tube bundles 2 and 8 that are arranged above one another and an inlet 26 for injecting a medium into the column between the tube bundles 2 and 8 that are arranged above one another;

FIG. 2 shows an embodiment of a tube bundle heat exchanger according to this invention with two tube bundles 2 and 8 that are arranged above one another and an inlet 26 in the column, which is located at the height of an end section 40 of the upper tube bundle 8;

Figure 2:
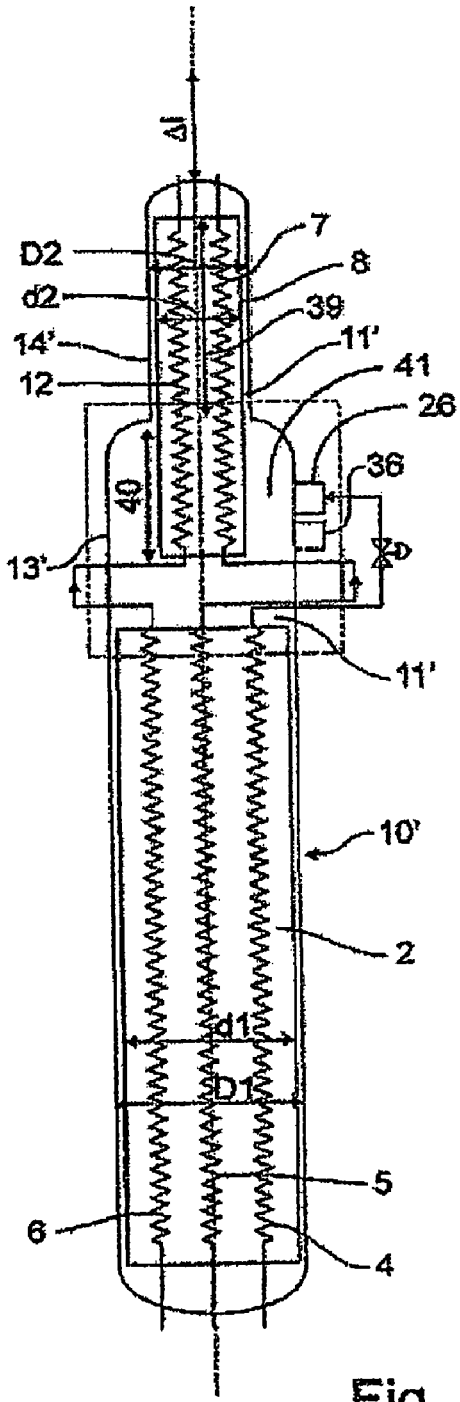
Fig. 2 Prior Art
Figure 4:
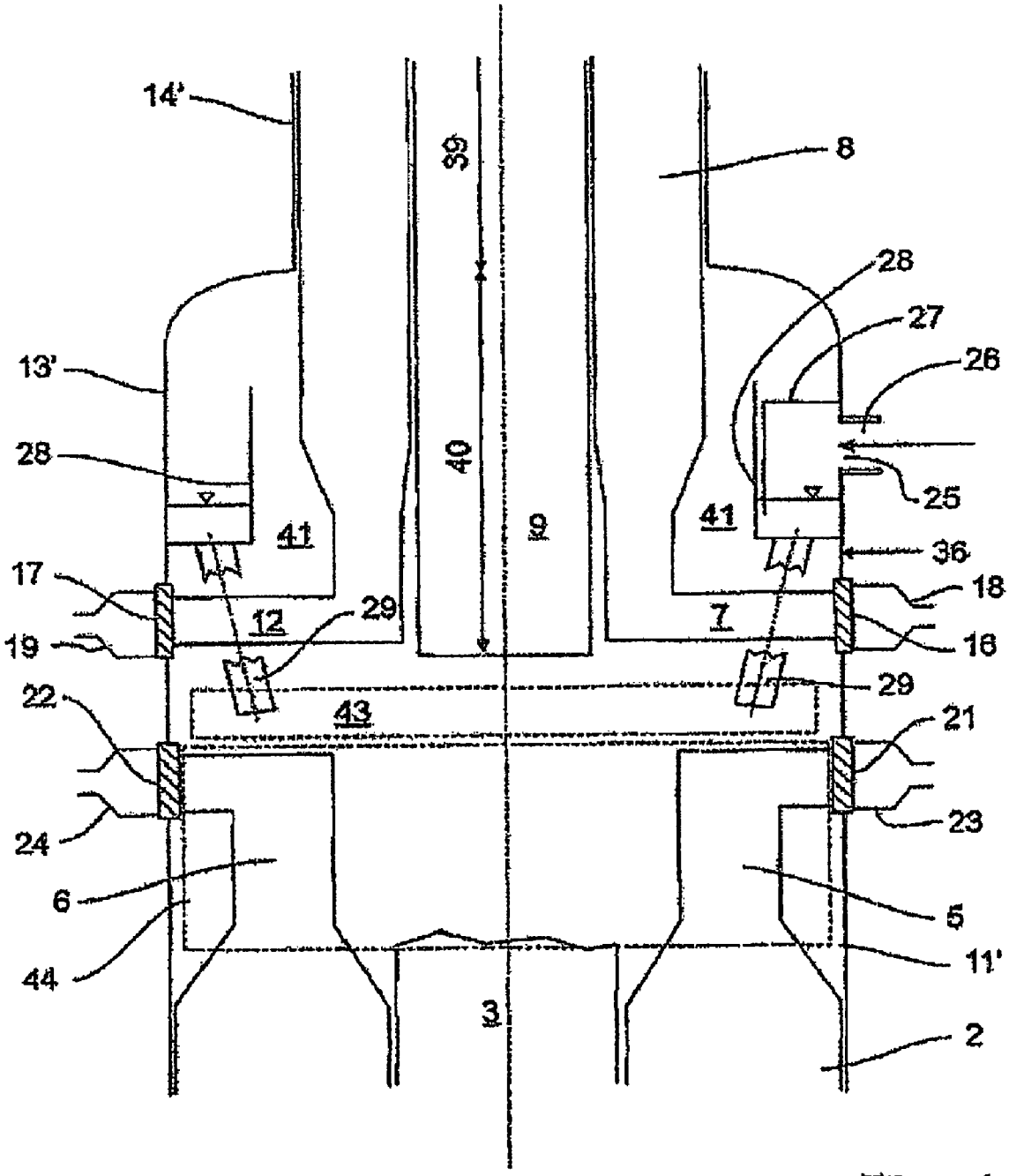
FIG. 4 shows a detail view of a section of the tube bundle heat exchanger of FIG. 2 according to the invention in the area between the first tube bundle 2 and the second tube bundle 8.
Figure 5:
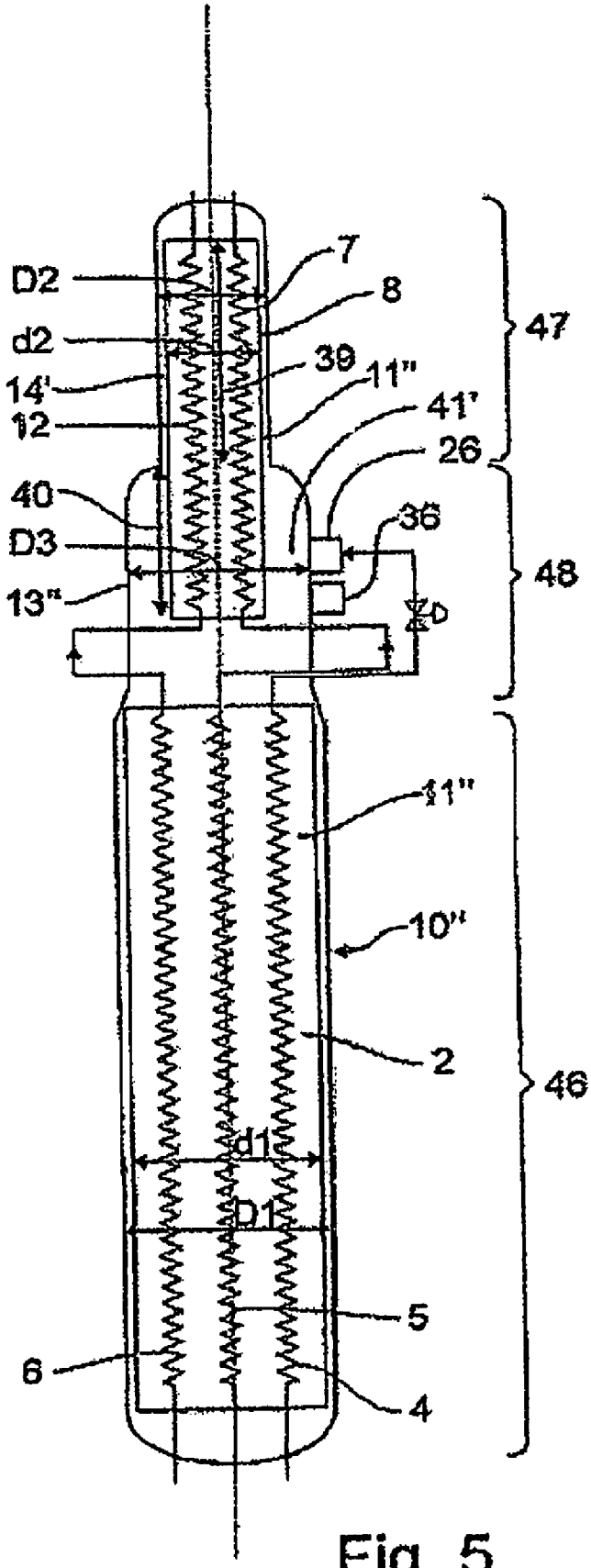
Figure 6:
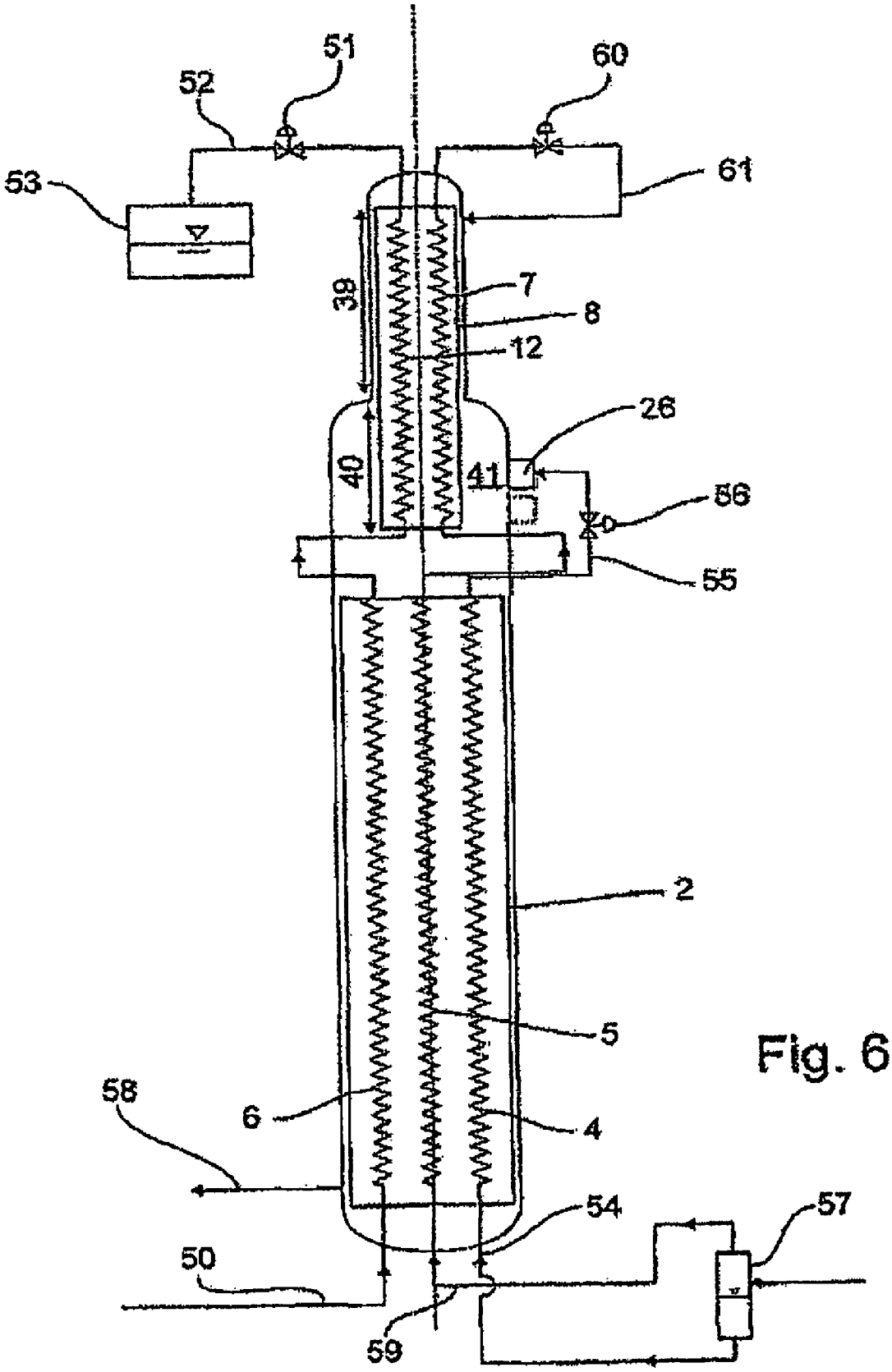
Figure 7:
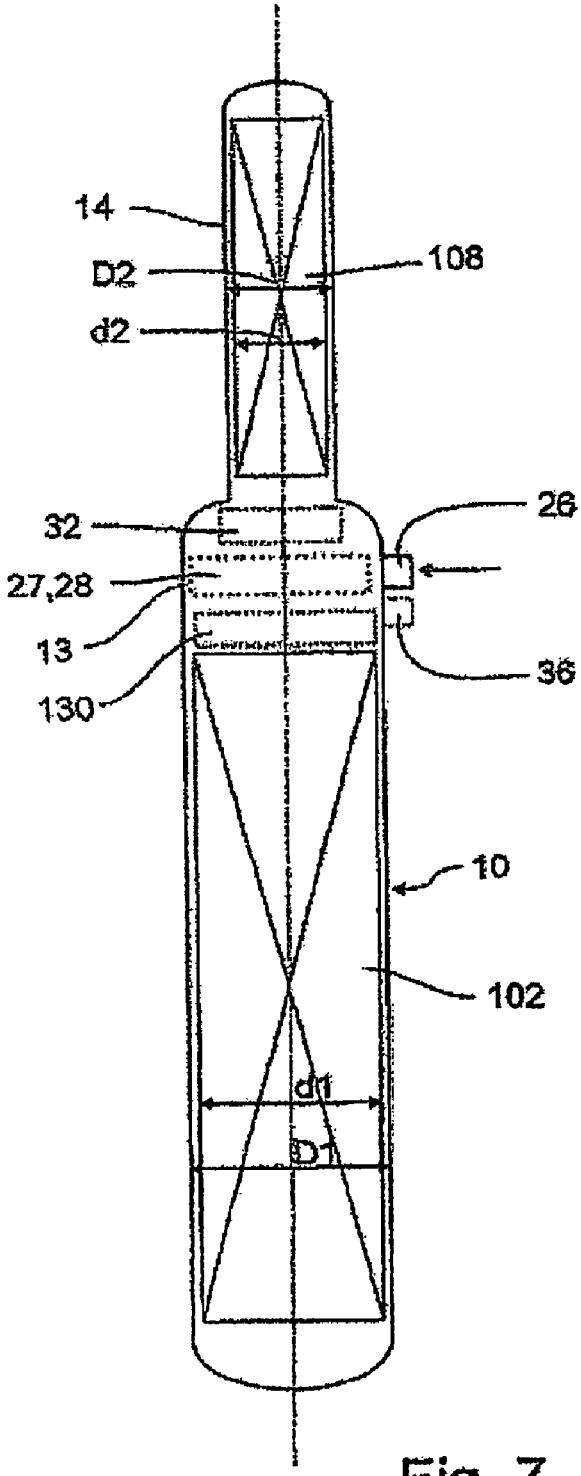
Figure 8:
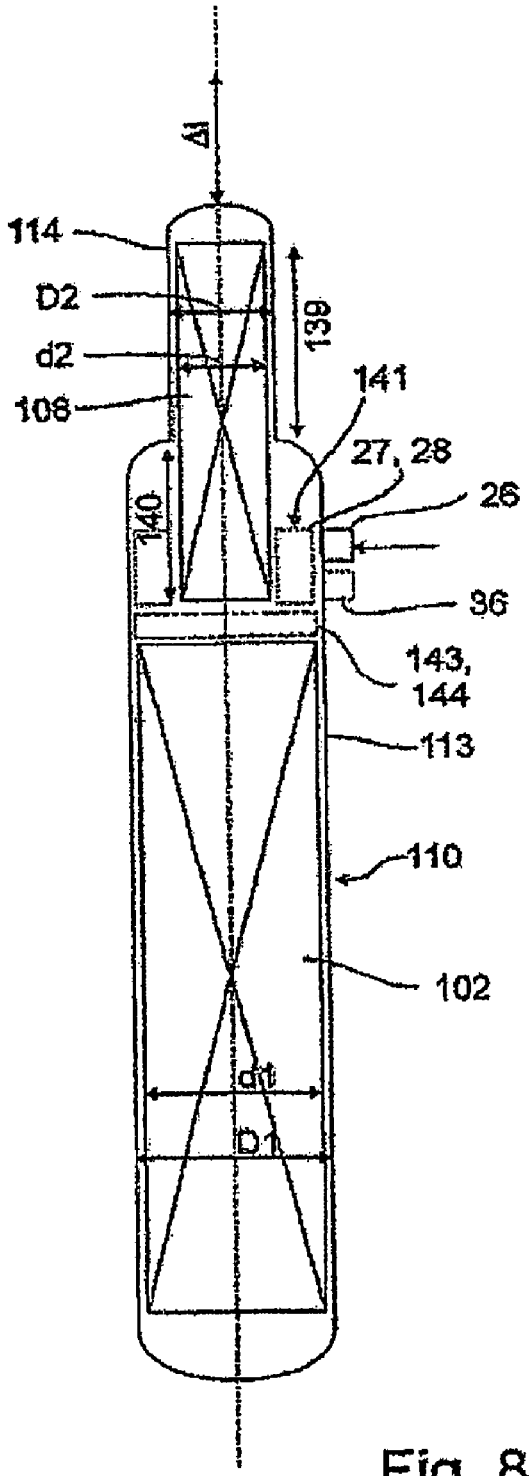
Fig. 8 Prior Art
Figure 9:
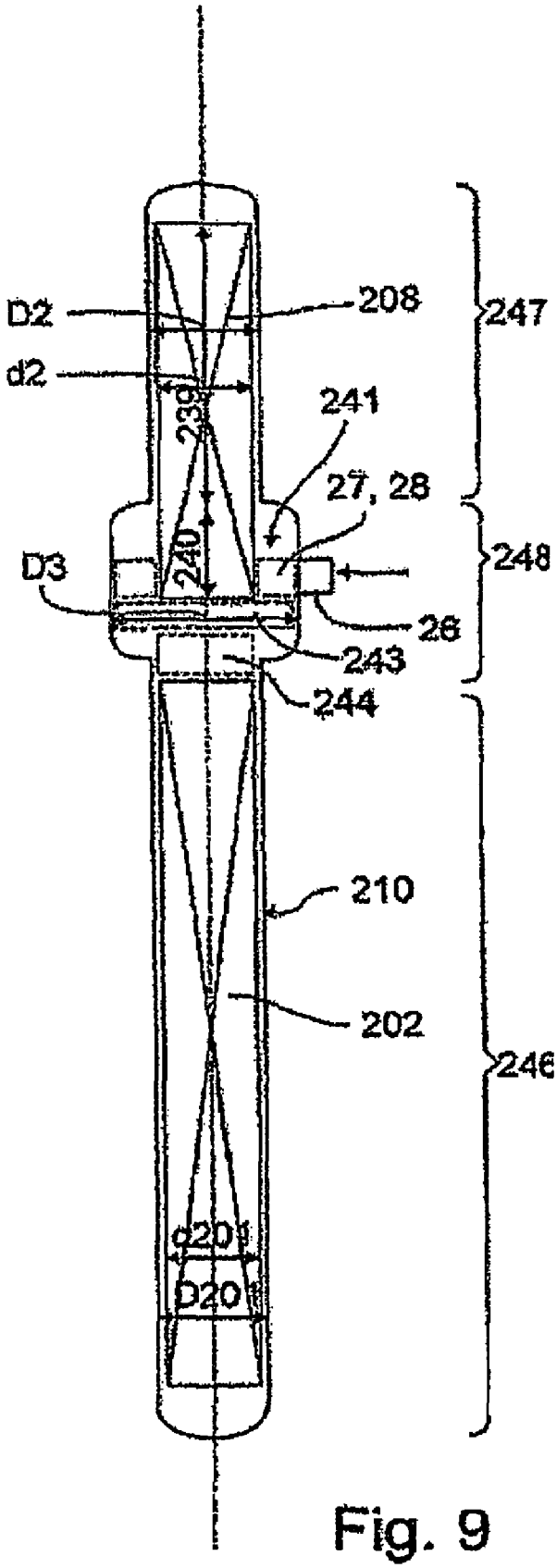

FIG. 5 shows a second embodiment of a tube bundle heat exchanger according to the invention with two tube bundles 2 and 8 that are arranged above one another and an inlet 26 at the level of a lower end section of the upper tube bundle 8;

FIG. 6 shows the tube bundle heat exchanger, shown in FIGS. 2 and 4, with main process streams in a process for liquefying natural gas;

FIG. 7 shows a mass transfer column according to the prior art with two mass transfer areas 102 and 108 of different diameters that are arranged above one another and an inlet 26 for injecting a medium into the column between the mass transfer areas 102 and 108;

FIG. 8 shows a first embodiment of a mass transfer column according to this invention with two mass transfer areas 102 and 108 of different diameters that are arranged above one another and an inlet 26 for injecting a medium into the column, whereby the inlet 26 is located at the height of a lower end section 140 of the upper mass transfer area 108;

FIG. 9 shows a second embodiment of a mass transfer column according to this invention with two mass transfer areas 202 and 208 that are arranged above one another, for example packings, of the same diameter, as well as an inlet 26 in the column that is located at the height of a lower end section 240 of the upper mass transfer area 208.

Figure 1:
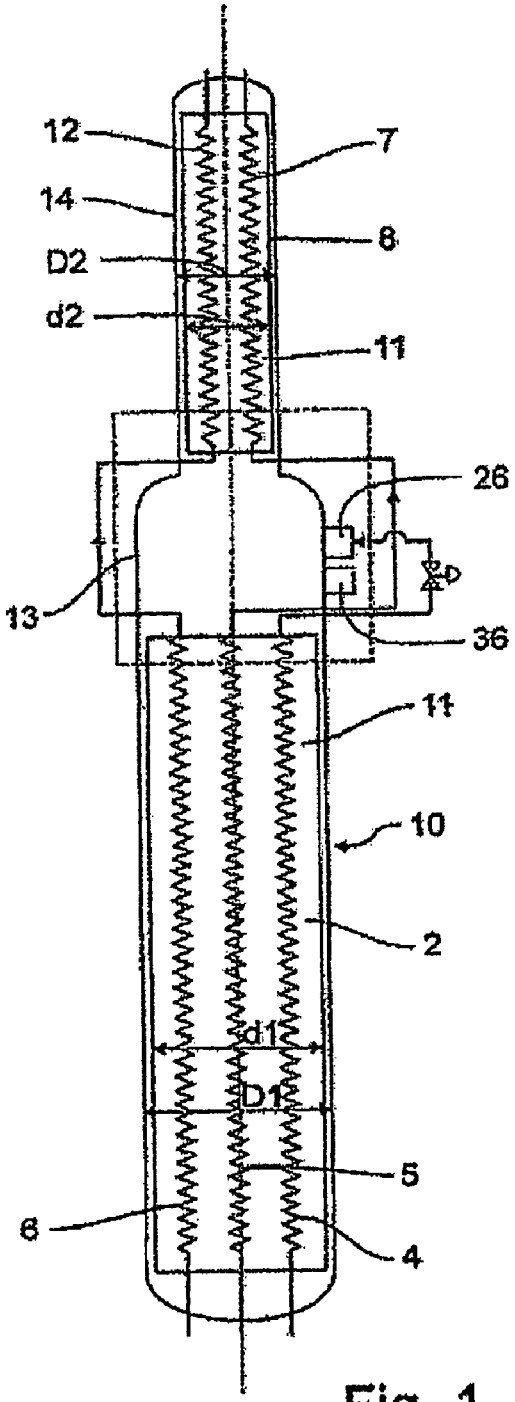
Figure 3:
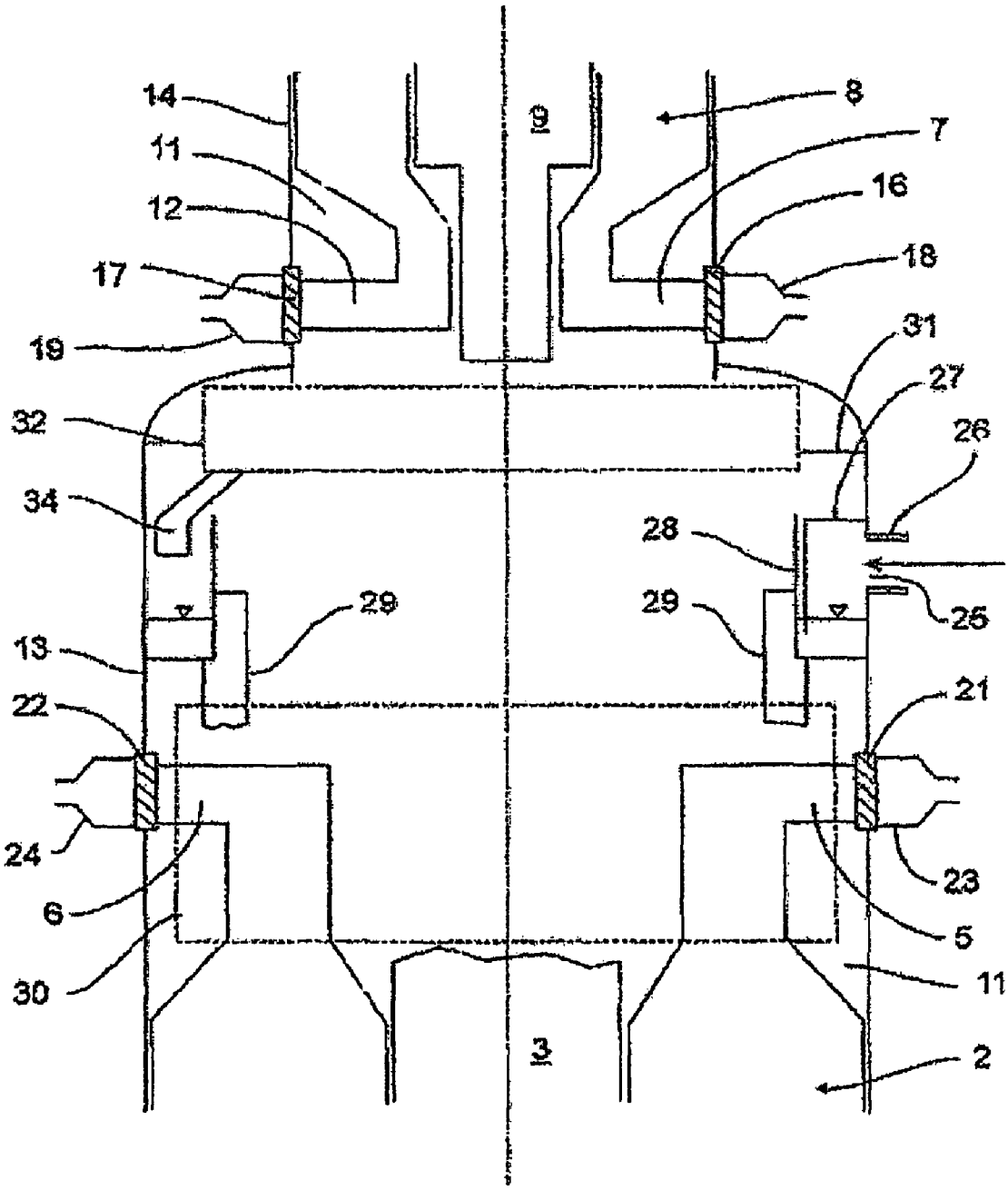
Fig. 3 Prior Art
FIG. 3 shows a detail view of a section of the tube bundle heat exchanger of FIG. 1 of the prior art in the area between the first tube bundle 2 and the second tube bundle 8.

FIGS. 1 and 3 show a tube bundle heat exchanger according to the prior art, which is used in, for example, a process for liquefying natural gas, with two tube bundles 2 and 8 that are arranged above one another, and an inlet 26 between the two tube bundles 2 and 8. The tube bundle heat exchanger was already described in detail in the specification introduction above. Reference is therefore made to the above specification.

FIGS. 2 and 4 show an embodiment of a tube bundle heat exchanger according to this invention also with two tube bundles 2 and 8 that are arranged above one another. FIG. 2 shows a diagrammatic comprehensive view, while FIG. 4 shows a cutaway in the area between the first tube bundle 2 and the second tube bundle 8. Components in which the tube bundle heat exchanger, shown in FIGS. 2 and 4, corresponds to the tube bundle heat exchanger shown in FIGS. 1 and 3 are provided with the same reference numbers. Reference is therefore made to the above specification of the tube bundle heat exchanger of FIGS. 1 and 3.

A comparison of FIGS. 2 and 4 with FIGS. 1 and 3 shows that in the tube bundle heat exchanger according to the invention, the second tube bundle 8 projects into the first cover part 13' over a portion of its length, namely a lower end section 40. To be able to completely occupy the lower end section 40 of the second tube bundle 8, the first cover part 13' is embodied extended upward above the upper end of the first tube bundle 2.

As can be seen from FIG. 4, the tube bottoms 16 and 17, in which the lower ends of the second tube bundle 8 are inserted, are arranged on the first cover part 13' and not on the second cover part 14 as in the tube bundle heat exchanger according to the prior art. Since the diameter D1 of the first cover part 13' is larger than the outside diameter d2 of the second tube bundle 8, an annular intermediate space 41 is produced between the end section 40 of the second tube bundle 8 and the first cover part 13'. In the area of this intermediate space 41, the inlet nozzle 26 for injecting a medium into the external space around the tubes of the first tube bundle 2 is arranged on the first cover part 13' at approximately the height of the lower winding end of the tube bundle 8 and thus above the tube bottoms 16 and 17. Also, the baffle box 27 and the ring pre-distributor 28 are arranged in this intermediate space 41. In the baffle box 27, a gas-liquid separation, i.e., phase separation, takes place in addition to a redirecting of the accompanying liquid medium in the ring pre-distributor 28. Via the inlet 26, a medium with liquid and gaseous proportions can thus be injected.

Thus, the inlet nozzles 26, the baffle boxes 27, as well as the ring pre-distributors 28 are arranged above the tube bottoms 16 and 17 and not—as in the tube bundle heat exchanger according to the prior art—in a section of the tube bundle heat exchanger between the lower tube bottoms 21 and 22 and the upper tube bottoms 16 and 17. Relative to the tube bundle heat exchanger of the prior art of FIGS. 1 and 3, the distance between the upper tube bottoms 16, 17 and the lower tube bottoms 21, 22 that is therefore required in longitudinal direction of the tube bundle heat exchanger in the tube bundle heat exchanger according to the invention and thus the distance between the first tube bundle 2 and the second tube bundle 8 are reduced. Thus, the structural height of the tube bundle heat exchanger according to the invention, which shows a comparison of FIG. 2 to FIG. 1, is also reduced relative to the tube bundle heat exchanger according to the prior art. The length of the tube bundle heat exchanger according to the invention is reduced by a length Δ1.

As can be seen from FIG. 4, the inlet nozzle 26 on the first cover part 13' is arranged approximately at the height of the lower winding end of the second tube bundle 8. The inlet 26 can also be arranged, however, above the lower winding end of the tube bundle 8 and thus is located in a height position in which the tubes that are wound on the central tube 9 form the shape of a hollow cylinder. The first cover part 13' must then be designed longer according to the above.

The tube bundle heat exchanger shown in FIGS. 2 and 4 can have, which is not shown, however, an additional, second inlet for injecting a medium into the external space 11' around the tube of the first tube bundle 2, which is arranged, for example, at the height of the already present inlet 26.

In addition, an inlet for injecting a medium into the external space 11' of the tubes is located at the top of the column above the second, upper tube bundle 8, which is not depicted, however, in FIGS. 2 and 4. The inlet 26 that is arranged in the area of the lower end section 40 of the tube bundle 8 thus is used as an intermediate inlet for intermediate injection of a medium into the column.

A manhole 36 that is depicted in dashed lines in FIG. 2 for accessibility of the external space 11' can also be arranged to reduce structural height on the cover part 13' in the area of the intermediate space 41, for example in the longitudinal direction of the tube bundle heat exchanger in a height position between the inlet nozzle 26 and the tube bottoms 16, 17, which is indicated with an arrow in FIG. 4. The inlet nozzle 26 in this case must be placed still somewhat higher, and thus the first cover part 13' has to be extended still further upward, since the inlet nozzle 26 has to be a certain distance from the manhole 36 and the manhole 36 has to be a certain distance from the tube bottoms 16, 17. Thus, for the manhole 36, no cover section has to be provided in longitudinal direction of the tube bundle heat exchanger between the upper tube bottoms 16, 17 and the lower tube bottoms 21, 22, which also reduces the structural height of the tube bundle heat exchanger. Thus, even in a tube bundle heat exchanger that does not have such an inlet 26 but rather has to have only one manhole 36 that is prescribed by regulations, for example, on the upper end of the first cover part 13, the structural heights are reduced.

The second cover part 14' of the tube bundle heat exchanger according to this invention is explained more briefly relative to the corresponding second cover part 14 of the tube bundle heat exchanger of the prior art, which can be seen in the comparison of FIG. 2 to FIG. 1. In this shortened, second cover part 14', an upper section 39 of the second tube bundle 8 is arranged. The lower end section 40 and the upper section 39 of the second tube bundle 8 together form the overall length of the second tube bundle 8.

As can be seen from FIG. 4, the tube bundle heat exchanger according to the invention in addition has a collecting device 43 that is indicated in dashed lines and in which liquid medium that flows out from the external space around the tubes of the second tube bundle 8 is collected together with the liquid medium that flows out into the drain pipe 29 of the ring pre-distributor 28 and then is distributed with a distributor 44 arranged thereunder via the cross-section of the first tube bundle 2 in the external space 11' around the tubes of the first tube bundle 2. Suitable distributors are described in, for example, DE 10 2004 040 974 A1.

FIG. 5 shows a second embodiment of a tube bundle heat exchanger according to this invention. In the latter, the first cover part 13" in an upper section 48, in which the tube bottoms 16, 17 and 21, 22 and the inlet 26 are arranged, has a smaller inside diameter D3 than a subjacent section 46 of the first cover part 13" with D1. The cover 10" of the embodiment depicted in FIG. 5 thus comprises three sections, a first cover section 46 with an inside diameter D1, a second cover section 47 with an inside diameter D2, and a third cover section 48 with an inside diameter D3 that is located between the first and the second cover sections. The first tube bundle 2 is arranged in the first cover section 46; the lower end section 40 of the second tube bundle 8 is arranged in the third cover section 48; and the residual length of the second tube bundle 8, i.e., the upper section 39 of the second tube bundle 8, is arranged in the second cover section 47.

The tube bundle heat exchanger of FIG. 2, 4 or 5 can be produced by two separate pieces of equipment first being manufactured, one of which comprises the first tube bundle 2 with the first cover part 13', 13" and the other comprises the second tube bundle 8 with the second cover part 14', 14". When assembling the two pieces of equipment the end section 40 of the second tube bundle 8 can then be inserted from above into the first cover part 13', 13", and the two pieces of equipment can be welded to one another. The cover parts 13', 13' and 14, 14" can in turn consist of several cover parts that are welded to one another. The first cover part 13" of the tube bundle heat exchanger of FIG. 5 would then comprise the cover sections 46 and 48, which have different inside diameters D1 and D3.

FIG. 6 shows the tube bundle heat exchanger of FIGS. 2 and 4 in a process for liquefying natural gas. The tube bundle heat exchanger that is shown in FIG. 5 can also be used, however.

The natural gas stream that is pretreated in preceding process steps enters from below via the line 50 with about 239K and 50 bar into the first tube bundle 2, flows through the tubes of the tube group 6 specific to it and then under further continuous cooling by the upper tube bundle 8 through the tubes of the tube group 12 until it can be filled after expansion via the throttle 51 in the line 52 in a tank 53.

The cooling of the natural gas stream is carried out in the tube bundle heat exchanger by indirect heat exchange with a refrigerant. In this case, this is a mixture that consists of, for example, nitrogen, methane, ethane and propane. After compression, cooling, and partial liquefaction of the refrigerant, the liquid fraction that is separated in a separator 57 enters via the line 54 from below into the first tube bundle 2 and flows through the tubes of the tube group 4, where the liquid fraction is subcooled and exits above via the line 55 from the first tube bundle 2. An expansion of the refrigerant stream via the throttle 56 is then carried out. The throttled, predominantly liquid refrigerant stream, which has a small proportion of gas, is then injected via the inlet 26 into the tube bundle heat exchanger and released as coolant via the redirecting, phase-separation and distributor devices 27 and 28 that are located in the intermediate space 41, described with reference to FIGS. 2 and 4, and via the distributor device 44 into the external space of the tubes of the three-part first tube bundle 2. It evaporates downstream at increasing temperature and is drawn off, completely gasified, via the line 58 at the lower end of the tube bundle heat exchanger.

The refrigerant stream that escapes in gaseous form from the separator 57 at 239 K via the line 59 is first cooled and partially liquefied in the tubes of the tube group 5 in the first, lower tube bundle 2 and is further liquefied and subcooled in the upper, second tube bundle 8 in the tubes of the tube group 7. After an expansion via a throttle 60 in the line 61, the refrigerant stream is injected at the top of the heat exchanger and released as refrigerant to the second, upper tube bundle 8, which then evaporates downstream and is mixed with the refrigerant stream that is injected via the inlet 26.

FIG. 7 shows a mass transfer column, for example a rectification column, according to the prior art, with two mass transfer areas 102 and 108, for example packings, that are arranged above one another as well as an inlet 26 for injecting a liquid medium into the first mass transfer area 102. The inlet 26, the baffle box 27, and the ring pre-distributor 28 occupy space between the upper end of the first mass transfer area 102 and the lower end of the second mass transfer area 108.

As can be seen from FIG. 8, in a first embodiment of a mass transfer column according to this invention, a lower end section 140 of the second mass transfer area 8 is inserted from above into the first cover part 113. Since the inside diameter D1 of the first cover part 113 is larger than the outside diameter d2 of the second mass transfer area 108, an annular intermediate space 141, which surrounds the lower end section 140, is also produced here. In the area of this intermediate space 141, the inlet 26 and optionally a manhole 36 are arranged on the cover part 113. The ring pre-distributor 28 and the baffle box 27 are located in the intermediate space. Since the inlet 26, optionally the manhole 36 and the pre-distributor 28 are arranged with the baffle box 27 in the column parallel to the second mass transfer area 108, no more space is required for this purpose in the column between the upper end of the first mass transfer area 102 and the lower end of the second mass transfer area 108. Thus, the structural height of the mass transfer can be reduced.

In FIG. 9, a mass transfer column of a second embodiment is shown. This mass transfer column is distinguished from that of FIG. 8 in that the outside diameter d201 of the first, lower mass transfer area 202 corresponds to the outside diameter d2 of the second mass transfer area 208. The cover 210 of the column has three sections, a first section 246, a second section 247, and a third section 248 that is located between the first and the second section. The inside diameter D201 and D2 of the first and second cover sections 246 and 247, which are matched to the outside diameter d201 and d2 of the first mass transfer area 202 or the second mass transfer area 208, are the same. In the area of a lower end section 240 of the second mass transfer area 208, the column diameter is enlarged to D3, by which an annular intermediate space 241 is formed. In the area of this intermediate space 241, i.e., at the height of the lower end section 240 of the second mass transfer area 208, the inlet 26 and the devices 27 and 28 are arranged for redirecting and pre-distributing the injected medium. The latter then do not require any more space between the upper end of the first mass transfer area 202 and the lower end of the second mass transfer area 208. The structural height of the column is thus reduced.

Also, a tube bundle heat exchanger according to this invention can be designed according to FIG. 9, whereby the mass transfer areas 202 and 208 are replaced by tube bundles.

In summary, the column examples that are shown in FIGS. 2, 4, 5, 6, 8 and 9 in each case have a column middle part with one or more of the following devices: an inlet, a manhole, as well as an outlet. The diameter of the column middle part is in each case larger than the diameter of the most narrow column part. The column middle part can have a smaller or larger diameter than—or the same diameter as—the widest column part.

Unlike in the embodiments depicted in FIGS. 1 to 9, the tube bundle heat exchanger or the mass transfer column can also comprise more than two, for example three, tube bundles or mass transfer areas.

For example, in FIG. 2, a third tube bundle can be arranged above the second tube bundle. If an injection and/or a manhole is also provided here, the third tube bundle in the area of a lower end section can also be surrounded here by a cover section of a larger diameter to provide an intermediate space. If the third tube bundle has a smaller outside diameter than the second tube bundle, the third tube bundle with a lower end section can project from above into the second cover part 14' as is the case in the second tube bundle 8 of FIG. 3, which projects with one end section 40 into the first cover part 13' of the larger tube bundle 2.

The embodiments of this invention that are shown in FIG. 2 to FIG. 9 can, which is not shown in the figures, however, also have an outlet, such as an outlet nozzle, instead of the inlet 26 or in addition to the inlet 26 in the area of the annular intermediate space 41, 41', 141 or 241, for example for removing a liquid or gaseous medium from the external space around the tubes of the tube bundle 2 or 8.

In general, the possibility also exists, which is not depicted in the figures, however, to surround an upper end section of the first mass transfer or heat-exchange area 2, 102, 202 with a cover section with an enlarged cover diameter to arrange an inlet, an outlet or a manhole parallel to this upper end section. In the case of the tube bundle heat exchanger of FIG. 4, this would mean that the inlet, outlet and/or manhole were arranged below the tube bottoms 21 and 22, into which the upper ends of the first, lower tube bundle 2 are inserted.

The invention claimed is:

1. Mass transfer or heat-exchange column with a first mass transfer or heat-exchange area (2; 102; 202), comprising a first tube bundle (2), and a second mass transfer or heat-exchange area (8; 108; 208), a second tube bundle (8), that is arranged spatially above the first mass transfer or heat-exchange area, which are surrounded by a cover (10'; 10"; 110; 210), as well as (a) at least one inlet (26) for injecting a medium into the column or (b) at least one manhole (36) for accessibility to the column or (c) at least one outlet for removing a medium from the column (8; 108; 208), characterized in that a first lower section (40; 140; 240) of the second mass transfer or heat-exchange area (8; 108; 208) is separated by a first intermediate space (41, 41'; 141; 241) from the cover (10'; 10"; 110; 120) of the column, whereby the first intermediate space (41; 41'; 141; 241) is formed such that the cover (10'; 10"; 110; 210) in the area of the first lower section (40; 140; 240) has a larger diameter (D1; D3) than in the area of a second upper section (39; 139; 239) of the second mass transfer or heat-exchange area (8; 108; 208)

and whereby the inlet (26) and/or the manhole (36) and/or the outlet is/are arranged in the area of the first intermediate space (41; 41'; 141; 241).

2. Mass transfer or heat-exchange column according to claim 1, wherein the column has a first cover part (13'; 13"; 113) with a first diameter (D1) and a second cover part (14'; 14"; 114) with a second diameter (D2), whereby the first diameter (D1) is larger than the second diameter (D2) and whereby the first mass transfer or heat-exchange area (2; 102) and the lower section (40; 140) of the second mass transfer or heat-exchange area (8; 108) are arranged in the first cover part (13'; 13"; 113) and the upper section (39; 139) of the second mass transfer or heat-exchange area is arranged in the second cover part (14'; 14"; 114).

3. Mass transfer or heat-exchange column according to claim 1, wherein the column has a first column section (46; 246) with a first diameter (D1; D201) and a second column section (47; 247) with a second diameter (D2) as well as a third column section (48; 248) with a third diameter (D3) that is located between the first and the second column section, whereby the first mass transfer or heat-exchange area (2; 202) is arranged in the first column section (46; 246), the lower section (40; 240) of the second mass transfer or heat-exchange area (8; 208) is arranged in the third column section (48; 248), and the upper section (39; 239) of the second mass transfer or heat-exchange area (8; 208) is arranged in the second column section (47; 247), whereby the third diameter (D3) is larger than the second diameter (D2) and the first diameter (D1, D201) is smaller or larger than the third diameter (D3).

4. Tube bundle heat exchanger comprising at least a first tube bundle (2) and a second tube bundle (8) that is arranged spatially above the first tube bundle (2), whereby the two tube bundles (2, 8) are surrounded by a cover (10', 10"), which defines an external space (11', 11") around the tubes of the two tube bundles (2, 8), and the tube bundle heat exchanger has an inlet (26) for injecting a fluid medium, into the external space around the tubes of the first tube bundle (2) and/or a manhole (36) for accessibility to the external space (11'; 11"), wherein a first, lower section (40) of the second tube bundle (2) is separated from the cover (10', 10") by an intermediate space (41; 41') that surrounds the first, in particular lower section (40), whereby the intermediate space (41; 41') is formed such that the cover (10', 10") in the area of the first, in particular lower section (40) of the second tube bundle (8) has a larger diameter (D1; D3) than in the area of a second, in particular upper section (39) of the second tube bundle (8), and whereby the inlet (26) and/or the manhole (36) is/are arranged in the area of the intermediate space (41; 41').

5. Tube bundle heat exchanger according to claim 4, wherein the first tube bundle (2) has a diameter (d1) that is distinguished from the diameter (d2) of the second tube bundle (8); the second tube bundle (8) has a smaller diameter (d2) than the first tube bundle (2).

6. Tube bundle heat exchanger according to 4, wherein one or more of the following devices are arranged in the intermediate space (41; 41'): a redirecting means for redirecting the injected medium (27), a phase-separating means for separating the injected medium (27) into its phases, a distributor (28) for distributing the injected medium into the external space (11', 11").

7. Tube bundle heat exchanger according to claim 4, wherein the cover (10', 10") has a first cover section (46) with a first diameter (D1) and a second cover section (47) with a second diameter (D2) as well as a third cover section (48) with a third diameter (D3) that is located between the first and second cover sections, whereby the first tube bundle (2) is arranged in the first cover section (46), the lower section (40) of the second tube bundle (8) is arranged in the third cover section (48), and the upper section (39) of the second tube bundle (8) is arranged in the second cover section (47), whereby the third diameter (D3) is larger than the second diameter (D2), and the first diameter (D1) is larger than the third diameter (D3).

8. Tube bundle heat exchanger according to claim 4, wherein the second tube bundle (8) comprises a large number of tubes, which are wound around a central tube (9), whereby the tubes are merged on the lower end of the second tube bundle (8) into one or more groups (7, 12) in one or more bundle devices (16, 17), tube bottoms, and whereby at least one inlet (26), a nozzle (26), for injecting a medium into the external space (11'; 11") and/or a manhole (36) is arranged at a height of the tube bundle heat exchanger that is located above at least one bundle device (16, 17).

9. In a process comprising an indirect heat exchange between a hydrocarbon-containing stream and at least one coolant or refrigerant, the improvement wherein the process is conducted in a heat exchange according to claim 4.

10. A process according to claim 9, wherein a refrigerant that is subcooled and then throttled in the tubes of the first tube bundle (2) is injected through an inlet (26) that is arranged in the area of the intermediate space (41, 41') and distributed into the external space around the tubes of the first tube bundle (2).

11. A process according to claim 9, wherein the hydrocarbon-containing stream is formed by natural gas.

12. Mass transfer or heat-exchange column according to claim 2, wherein the column has a first column section (46; 246) with a first diameter (D1; D201) and a second column section (47; 247) with a second diameter (D2) as well as a third column section (48; 248) with a third diameter (D3) that is located between the first and the second column section, whereby the first mass transfer or heat-exchange area (2; 202) is arranged in the first column section (46; 246), the lower section (40; 240) of the second mass transfer or heat-exchange area (8; 208) is arranged in the third column section (48; 248), and the upper section (39; 239) of the second mass transfer or heat-exchange area (8; 208) is arranged in the second column section (47; 247), whereby the third diameter (D3) is larger than the second diameter (D2) and the first diameter (D1, D201) is smaller or larger than the third diameter (D3).

13. Tube bundle heat exchanger according to 5, wherein one or more of the following devices are arranged in the intermediate space (41; 41'): a redirecting means for redirecting the injected medium (27), a phase-separating means for separating the injected medium (27) into its phases, a distributor (28) for distributing the injected medium into the external space (11', 11").

14. Tube bundle heat exchanger according to 12, wherein one or more of the following devices are arranged in the intermediate space (41; 41'): a redirecting means for redirecting the injected medium (27), a phase-separating means for separating the injected medium (27) into its phases, a distributor (28) for distributing the injected medium into the external space (11', 11").

15. Tube bundle heat exchanger according to claim 5, wherein the cover (10', 10") has a first cover section (46) with a first diameter (D1) and a second cover section (47) with a second diameter (D2) as well as a third cover section (48) with a third diameter (D3) that is located between the first and second cover sections, whereby the first tube bundle (2) is arranged in the first cover section (46), the lower section (40) of the second tube bundle (8) is arranged in the third cover section (48), and the upper section (39) of the second tube bundle (8) is arranged in the second cover section (47), whereby the third diameter (D3) is larger than the second diameter (D2), and the first diameter (D1) is larger than the third diameter (D3).

16. Tube bundle heat exchanger according to claim 6, wherein the cover (10', 10") has a first cover section (46) with a first diameter (D1) and a second cover section (47) with a second diameter (D2) as well as a third cover section (48) with a third diameter (D3) that is located between the first and second cover sections, whereby the first tube bundle (2) is arranged in the first cover section (46), the lower section (40) of the second tube bundle (8) is arranged in the third cover section (48), and the upper section (39) of the second tube bundle (8) is arranged in the second cover section (47), whereby the third diameter (D3) is larger than the second diameter (D2), and the first diameter (D1) is larger than the third diameter (D3).

17. Tube bundle heat exchanger according to claim 14, wherein the cover (10', 10") has a first cover section (46) with a first diameter (D1) and a second cover section (47) with a second diameter (D2) as well as a third cover section (48) with a third diameter (D3) that is located between the first and second cover sections, whereby the first tube bundle (2) is arranged in the first cover section (46), the lower section (40) of the second tube bundle (8) is arranged in the third cover section (48), and the upper section (39) of the second tube bundle (8) is arranged in the second cover section (47), whereby the third diameter (D3) is larger than the second diameter (D2), and the first diameter (D1) is larger than the third diameter (D3).

* * * * *